US006112694A

United States Patent [19]

Burgos

[11] Patent Number: 6,112,694

[45] Date of Patent: Sep. 5, 2000

[54] DECK BOX FOR MARINE VESSEL

[76] Inventor: Glenn D. Burgos, 446 Hoffman La., Hauppauge, N.Y. 11788

[21] Appl. No.: 09/280,739

[22] Filed: Mar. 29, 1999

[51] Int. Cl.[7] ..... B63B 17/00

[52] U.S. Cl. ..... 114/364; 114/201 R

[58] Field of Search ..... 220/288, 293, 220/296, 297, 300, 301; 114/201 R, 343, 364; 116/277; 137/553

[56] References Cited

U.S. PATENT DOCUMENTS

| | | | |
|---|---|---|---|
| 4,203,686 | 5/1980 | Bowman | 404/25 |
| 4,280,434 | 7/1981 | Beckerer, Jr. | 114/201 R |
| 4,334,630 | 6/1982 | Bergin | 220/300 |

*Primary Examiner*—Ed Swinehart
*Attorney, Agent, or Firm*—Levine & Mandelbaum

[57] ABSTRACT

A deck box for mounting within the opening in the deck of a marine vessel. The deck box includes a cylindrical housing, a circular cover for closing the open upper end of the housing, and elements for securing the cover within the housing. The securing elements include a radially extending locking tongue carried by, and beneath, the cover, and an arcuate groove located within the housing, the groove extending for less than the full circumference of the housing interior. The groove has a tongue-entry end and a tongue-locking end, and a downwardly facing cam surface inclined downwardly from the entry end toward the locking end of the groove. When the cover is inserted into the housing with the locking tongue at the entry end of the groove, rotation of the tongue causes it to slide along the cam surface of the groove and draw the cover downwardly into the housing. The cam surface of the groove has a latch point between its entry and locking ends, at which the cam surface becomes inclined upwardly, thereby defining a locking position for the tongue between the latch point and the locking end of the groove. An O-ring, between the cover and shell, is compressed as the cover moves into the shell and serves to urge the tongue against the cam surface. The cover includes an outer ring and an inner disk rotatable within the ring, the tongue being fixed to the disk. A conventional deck box having a housing formed with an internal screw thread can be retrofitted with an adapter ring having an external screw thread cooperable with the internal screw thread of the shell, and an internal groove cooperable with a tongue carried by the cover.

15 Claims, 8 Drawing Sheets

DECK BOX FOR MARINE VESSEL

BACKGROUND OF THE INVENTION

1. Field of the Invention

Many marine vessels, especially large ships, have deck boxes mounted within openings in the deck of the vessel. The deck box is closed by a removable cover, and the mounting is such that the covered box is substantially flush with the surface of the deck.

Removal of the cover provides access to mechanism within the deck box for operating otherwise inaccessible devices located throughout the ship. Most commonly, these devices are valves for controlling flow of liquids into and out of tanks carried by the ship.

2. Description of Prior Art

An example of a conventional deck box is illustrated and described in U.S. Pat. No. 4,655,160. Typically, the deck box includes a cylindrical housing permanently secured within an opening in the deck, such as by welding or bolting. The housing is provided with an internal screw thread which cooperates with an external screw thread formed in the deck box cover. Thus, the deck box is closed by screwing the cover into the housing as far as possible, and opened by unscrewing the cover from the housing.

Use of screw threads on the cover and housing present a number of problems. Although the cover fits reasonably tightly in the housing, nevertheless grit and other foreign matter, such as wax, find their way into and between the screw threads making the cover difficult to open and close. This necessitates time being spent cleaning the screw threads, which still does not completely eliminate the problem. In addition, because, over time, the cover becomes difficult to screw into the housing, it is sometimes difficult to know whether or not the cover has been screwed all the way into the housing as far as it will go. This is important, since inserting the cover to its maximum depth insures that the O-ring, provided between the cover and shell, is squeezed tightly to make the closure water-tight. Moreover, screwing and unscrewing the cover is relatively time consuming, which can present a problem when quick access to a valve is required.

It is an object of the present invention to overcome these problems by eliminating the screw thread connection between the cover and housing, and thereby eliminating the problems attendant to use of screw threads.

BRIEF SUMMARY OF THE INVENTION

It is another object of the invention to provide a deck box having a cover which closes and opens the housing in response to a quick turn as compared to the multiple revolutions of the cover required by a screw thread connection.

It is a further object of the invention to provide such a deck box which is substantially unaffected by grit and other foreign matter which may find its way between the cover and housing of the deck box.

It is an additional object of the invention to provide a deck box which indicates to the user, by feel, that the cover has been inserted to its fully closed position.

Additional objects and features of the invention are set forth in the following description, in which reference is made to the accompanying drawings.

In the drawings:

DESCRIPTION OF THE PREFERRED EMBODIMENTS

Figure 1:
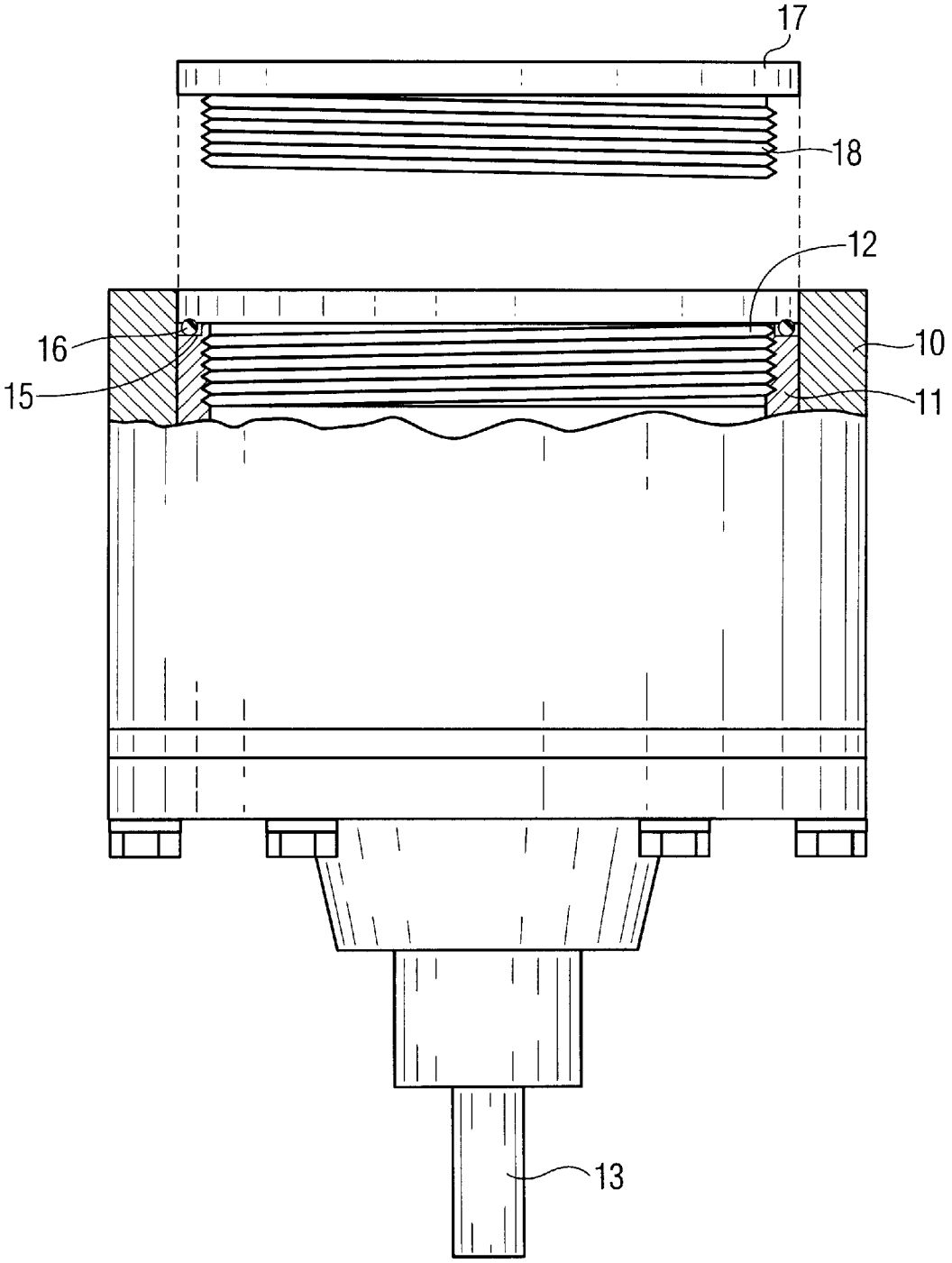
FIG. 1 PRIOR ART
FIG. 1 is an elevational view, partly in section, showing a typical deck box of the prior art.

A conventional deck box for a marine vehicle includes, as shown in FIG. 1, an outer cylindrical sleeve 10 adapted to be accommodated by an opening in the deck of a vessel, and fixed to the deck, such as by welding or bolts. Within the sleeve is a cylindrical shell 11 fixed to the sleeve, such as by screws (not shown). Shell 11 is furnished with an interior screw thread 12 surrounding the open upper end of the shell, and hence located within the open upper end of sleeve 10. Together, sleeve 10 and shell 11 comprise a housing which accommodates a rotatable mechanism (not shown) fixed to a rotatable spindle 13 depending from the deck box. When the deck box is fully installed, spindle 13 is coupled to suitable linkages capable of operating a valve or other mechanism within the ship. Thus, by means of a suitable tool, such as a T-wrench 14 (FIG. 2), the mechanism within housing 10,11 can be rotated so as to rotate spindle 13 and hence operate a remote valve or other mechanism.

Shell 11 is recessed a small distance inside sleeve 10, and formed with an annular recess 15 accommodating a resilient O-ring 16.

A cover for closing the open upper end of the housing 10,11 includes a disk 17 having a depending externally threaded nipple 18. To close the housing, nipple 18 is threaded into the shell 11, by means of threads 12, the disk 17 of the cover fitting into the recess of the housing, so that the closed cover is flush with the upper surface of sleeve 10. The deck box housing is, itself, mounted so as to be substantially flush with the upper surface of the vessel deck.

Figure 2:
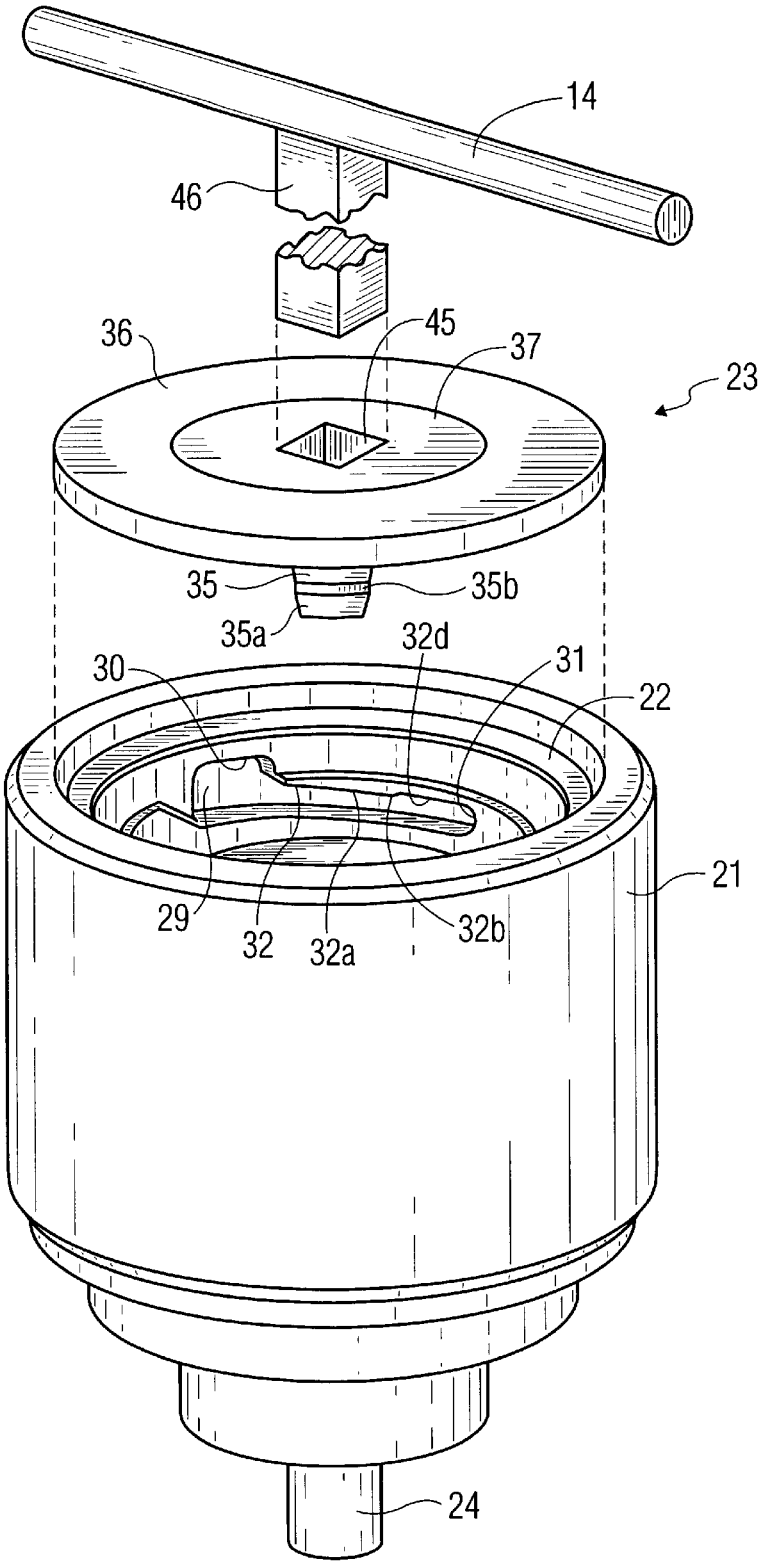
FIG. 2 is an exploded perspective view of a deck box according to the present invention, including a conventional T-wrench used to open and close the cover.
Figure 3:
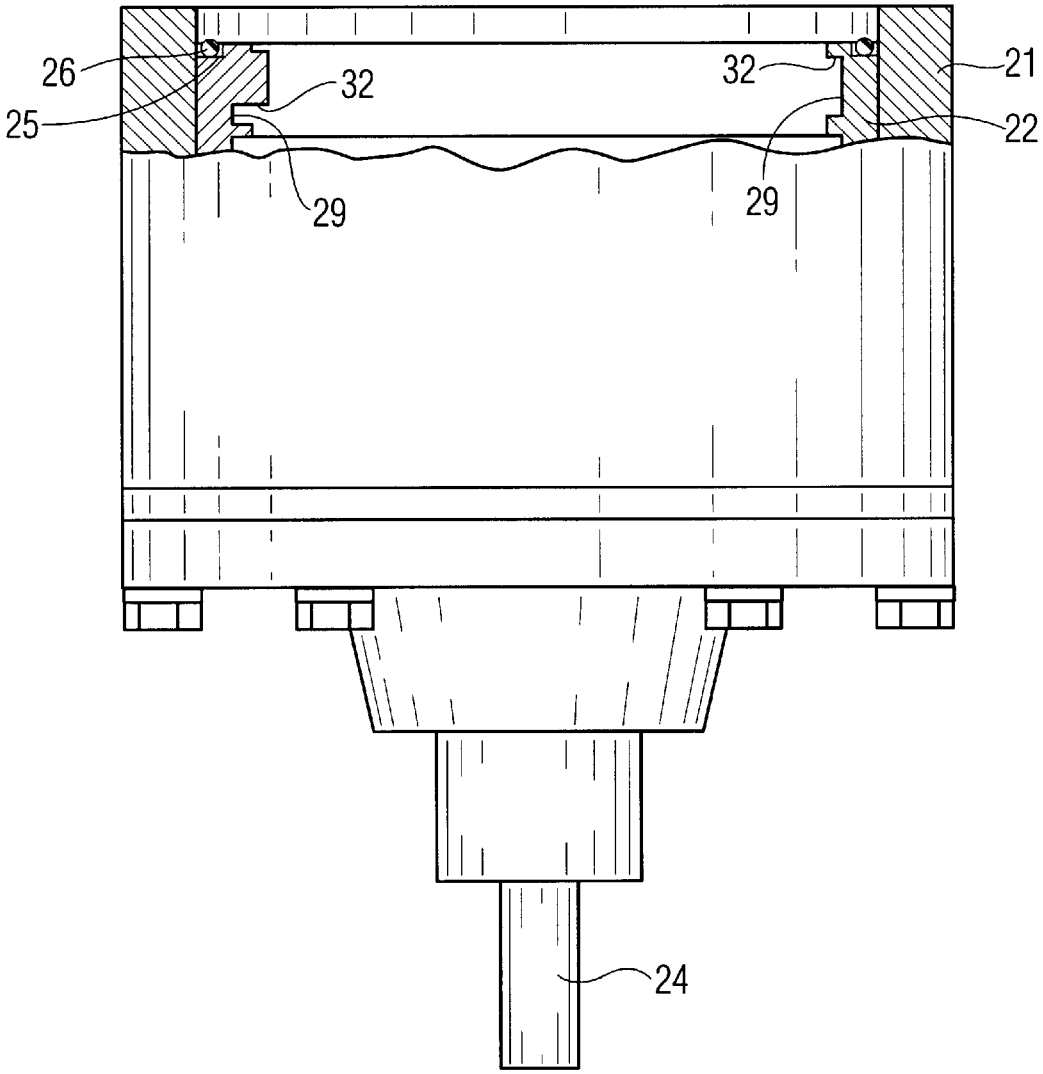
FIG. 3 is an elevational view, partly in section, showing an open deck box housing according to this invention, the cover having been removed.

The deck box chosen to illustrate the present invention, and shown in FIGS. 2 and 3, comprises a cylindrical housing including an outer sleeve 21 adapted to be accommodated by an opening in the deck of a vessel, and fixed to the deck, such as by welding or bolts. Within the sleeve is a cylindrical shell 22 fixed to the sleeve, such as by screws (not shown). The deck box also includes a cover 23 which will be described in greater detail below with reference to FIGS. 4–7. As in the prior art, housing 21,22 accommodates a rotatable mechanism (not shown) fixed to a rotatable spindle 24 depending from the deck box. In a conventional manner, spindle 24 is coupled to suitable linkages capable of operating a valve or other mechanism within the ship. Shell 22 is recessed a small distance inside sleeve 21 so that when the housing 21,22 is closed by cover 23, the upper surface of the cover will be flush with the upper surface of sleeve 21. Sleeve 22 is formed with an annular recess 25 accommodating a resilient O-ring 26.

As contrasted with the screw thread 12 provided in the shell 11 of the prior art, the interior surface of shell 22 of the present invention is instead formed with at least one, and preferably a series of grooves 29, only one of the grooves being clearly visible in FIG. 2. In the present example, shell 22 is formed with three grooves 29 spaced circumferentially around the shell, each groove having an arcuate shape which confirms to the circular shape of the sleeve. Preferably, each groove extends for approximately 90° in circumferential length.

Figure 8:
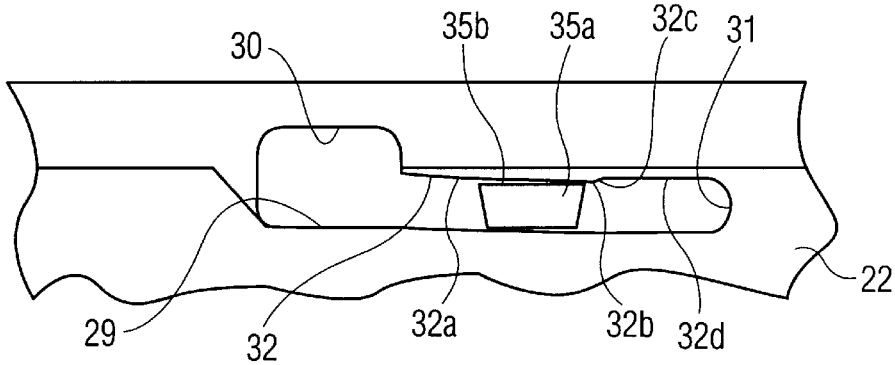
FIG. 8 is a fragmentary schematic view showing the relative positions of the cover tongue and shell groove when the cover is partially inserted into the shell.

Each groove 29 (see FIGS. 2, 8, and 9) has a radially-enlarged entry end 30 and a locking end 31. Between its ends, each groove 29 is formed with a downwardly facing cam surface 32. A portion 32*a* of cam surface 32 begins at entry end 30 and inclines downwardly toward locking end 31 until it reaches a latch point 32*b*. From latch point 32*b*, cam surface 32 becomes inclined upwardly for a short length 32*c*, after which the cam surface becomes substantially horizontal in its portion 32*d* adjacent to locking end 31. The three grooves 29 cooperate with three tongues 35 carried by cover 23 in order to lock the cover in place when the deck box is closed.

Figure 4:
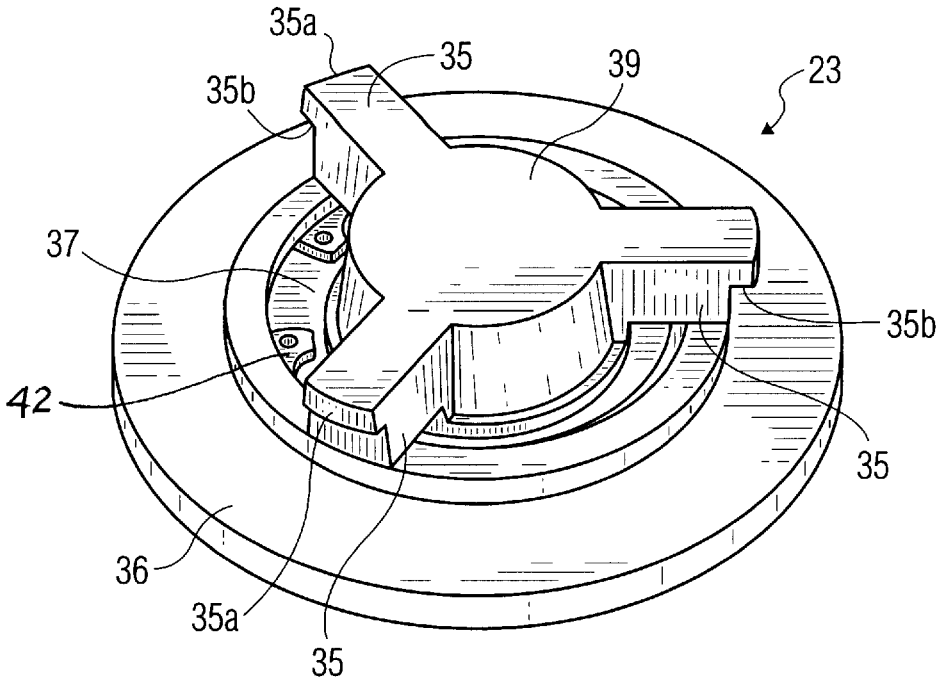
FIG. 4 is a perspective view of the under side of the deck box cover.
Figure 5:
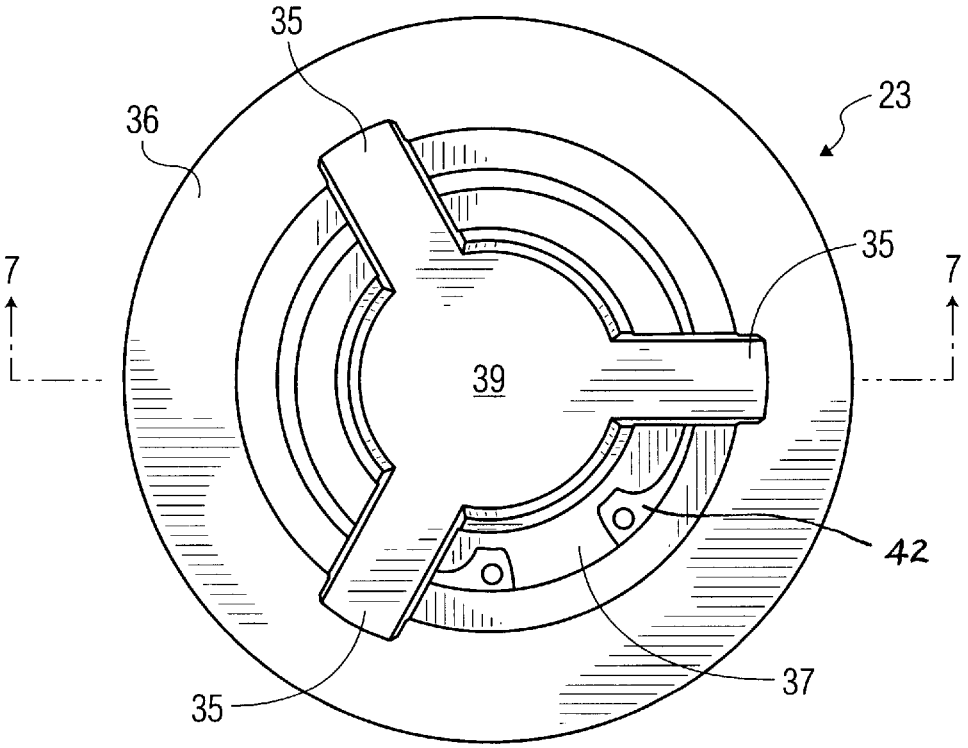
FIG. 5 is a bottom view of the deck box cover.
Figure 6:
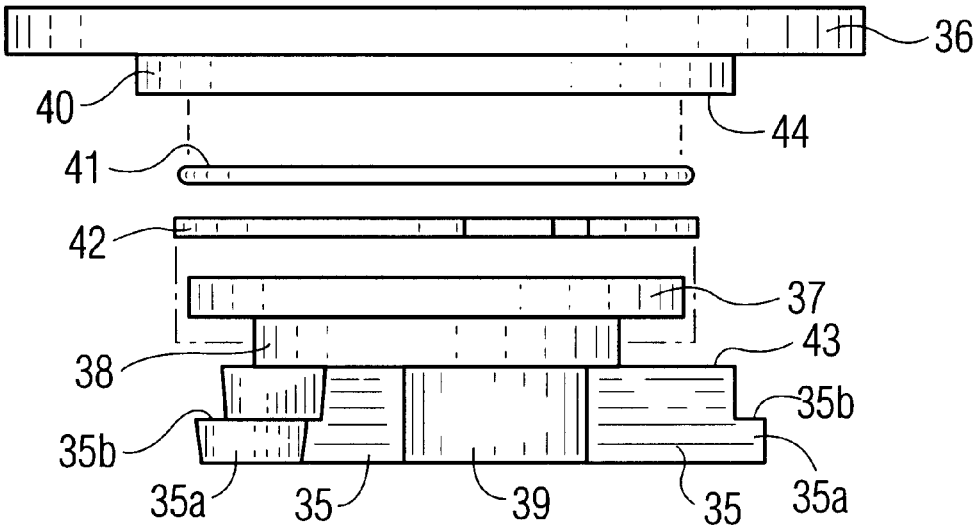
FIG. 6 is an exploded elevational view of the deck box cover.
Figure 7:
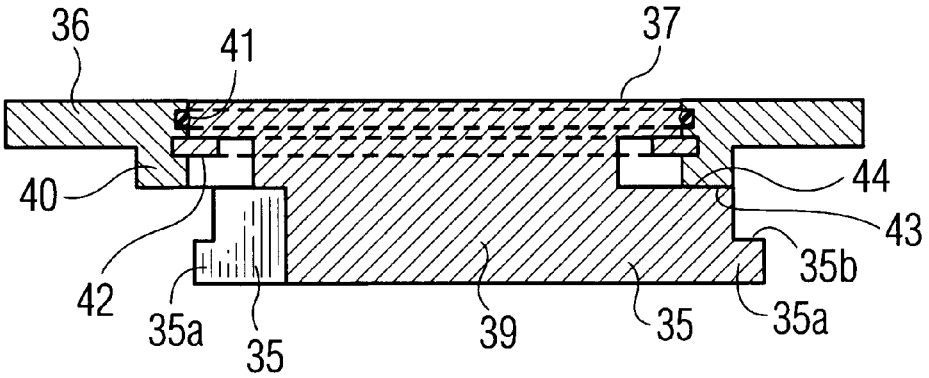
FIG. 7 is a cross sectional view of the cover.

Referring to FIGS. 2 and 4–7, cover 23 is a disk-like element comprising an outer ring 36 holding an inner disk 37, the disk being rotatable within ring 36. Depending from disk 37 is a neck 38 (FIGS. 6 an 7), carrying a hub 39 from which tongues 35 project radially, the tongues being spaced apart at 120° from each other in the circumferential direction of the cover. Each tongue terminates at its free end in a thinner tongue extension 35*a* having an upper surface 35*b* (FIGS. 4,6 and 7).

Depending from the lower surface of ring 36 is a boss 40 sized to permit disk 37 to pass through it. Disk 36 and boss 40 are formed with two internal annular grooves (FIG. 7) the upper one of which accommodates an O-ring 41. The lower groove is adapted to accommodate a snap ring 42. To assemble the parts of the cover 23, O-ring 41 is installed in its groove, after which disk 37 is passed upwardly through boss 40 into ring 36 until the upper surfaces 43 of tongues 35 engage the lower surface 44 of boss 40. Thereafter, snap ring 42 is installed in its groove to hold the parts together while permitting relative rotation between ring 36 and disk 37. Since tongues 35 are fixed to disk 37, tongues 35 are also rotatable with respect to ring 36. In its upper surface, disk 37 is formed with a square receptacle 45 (FIG. 2) adapted to receive the square cross-section body 46 of T-wrench 14. In this way, wrench 14 can be used to lock and unlock the cover 23 to housing 21,22.

Figure 9:
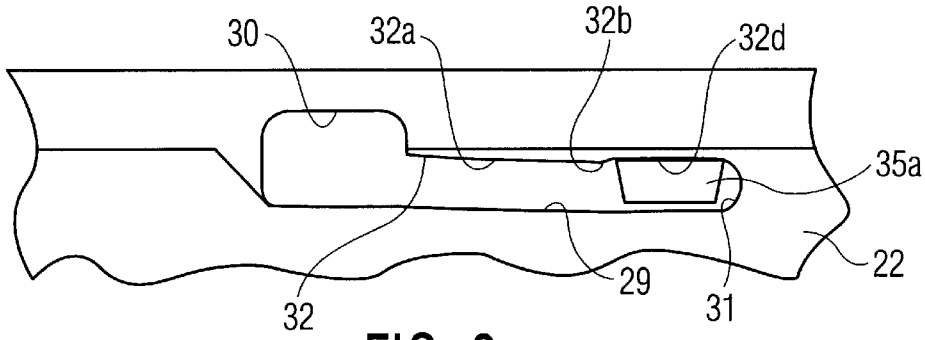
FIG. 9 is a view similar to FIG. 8 showing the relative positions of the tongue and groove when the cover is in its final closed position within the shell.
Figure 10:
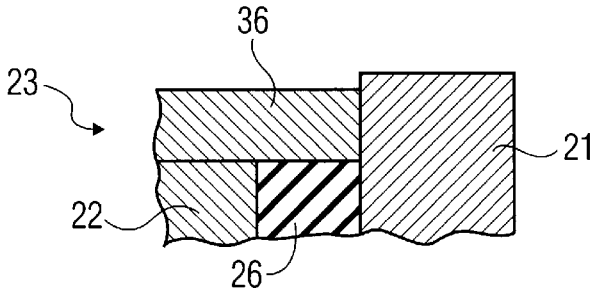
FIG. 10 illustrates the condition of the O-ring between the cover and shell when the parts are in the position indicated by FIG. 8.
Figure 11:
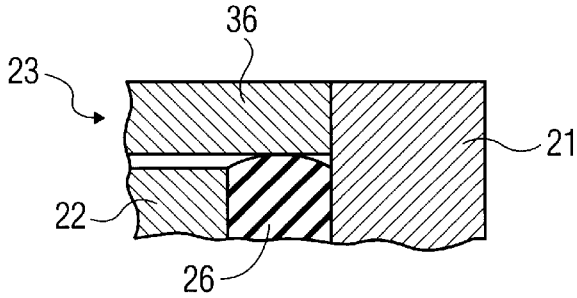
FIG. 11 illustrates the condition of the O-ring when the parts are in the position illustrated by FIG. 9.

When the open upper end of deck box housing 21,22 is to be closed, cover 23 is placed into the housing such that ring 36 fits within the upper end of sleeve 10 and the lower face of ring 36 seats upon O-ring 26. At the same time, each tongue 35 carried by the cover is passed downwardly through the tongue entry-end 30 of one of the grooves 29. Using wrench 14, disk 37 is turned clockwise, as viewed from above, so that the upper surface 35*b* of each tongue extension 35*a* slides along cam surface portion 32*a*, drawing cover 23 further downwardly into the housing 21,22. When each tongue extension 35*a* reaches the lowest point of cam surface 32*a* (FIG. 8), resilient O-ring 26 is squeezed to its maximum extent by ring portion 36 of the cover (FIG. 10). Continued rotation of disk 37, and hence tongues 35, moves each tongue extension 35*a* past latch point 32*b*, and up along cam portion 32*c* to its final location in which tongue surface 35*b* engages cam surface 32*d* (FIG. 9). During this last portion of the movement of tongues 35, the pressure on O-ring 26 is slightly relieved (FIG. 11) since each tongue extension has passed upwardly along inclined cam surface portion 32*c*. The resilient nature of O-ring 26 maintains each tongue against cam surface portion 32*d*, and upwardly inclined portion 32*c* of the cam surface prevents accidental rotation of the tongues, such as due to vibrations or otherwise, toward an unlocking position.

To open the deck box, wrench 14 is used to rotate disk 37 in a counter-clockwise direction, as viewed from above, causing each tongue extension to slide first downwardly along cam surface portion 32*c*, past latch point 32*b*, and then upwardly along cam surface portion 32*a* until the tongues reach the entry ends 30 of the grooves, whereupon the cover can be lifted out of the deck box housing.

Cover 23 could be made so that ring 36 and disk 37 are a single piece or a unitary assembly. However, there is an advantage to fabricating the cover as shown in the drawings and described above. When cover 23 has been in place for some time within housing 21,22, and the cover has been pressed against O-ring 26, it often happens that the O-ring sticks to the under surface of the cover. As a result, if the cover is made as one piece, the entire cover must be rotated by wrench 14 in order to open the deck box, and initiating this rotation can be difficult because of the adherence of O-ring 26 to the cover. With the present construction, this potential problem is avoided. Since only the disk 37 and tongues 35 are rotated to unlock the cover for removal, ring 36, which is pressed against O-ring 26, need not rotate. Consequently, even should O-ring 26 adhere to the under surface of ring 36, this will have no effect on the rotation of disk 37 and tongues 35. Once the tongues reach the entry ends 30 of grooves 29, the cover can readily be lifted off O-ring 26 and out of the housing.

Figure 13:
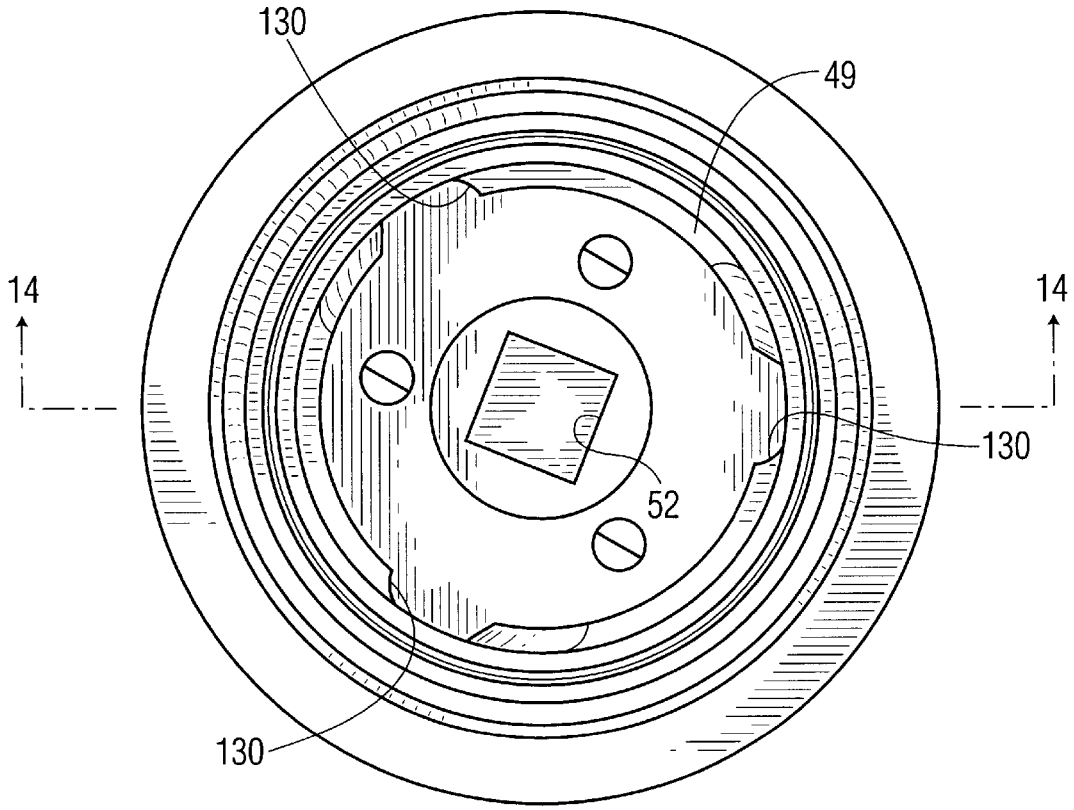
FIG. 13 is a top view of the adapter shown in FIG. 12 assembled with a conventional deck box housing.
Figure 14:
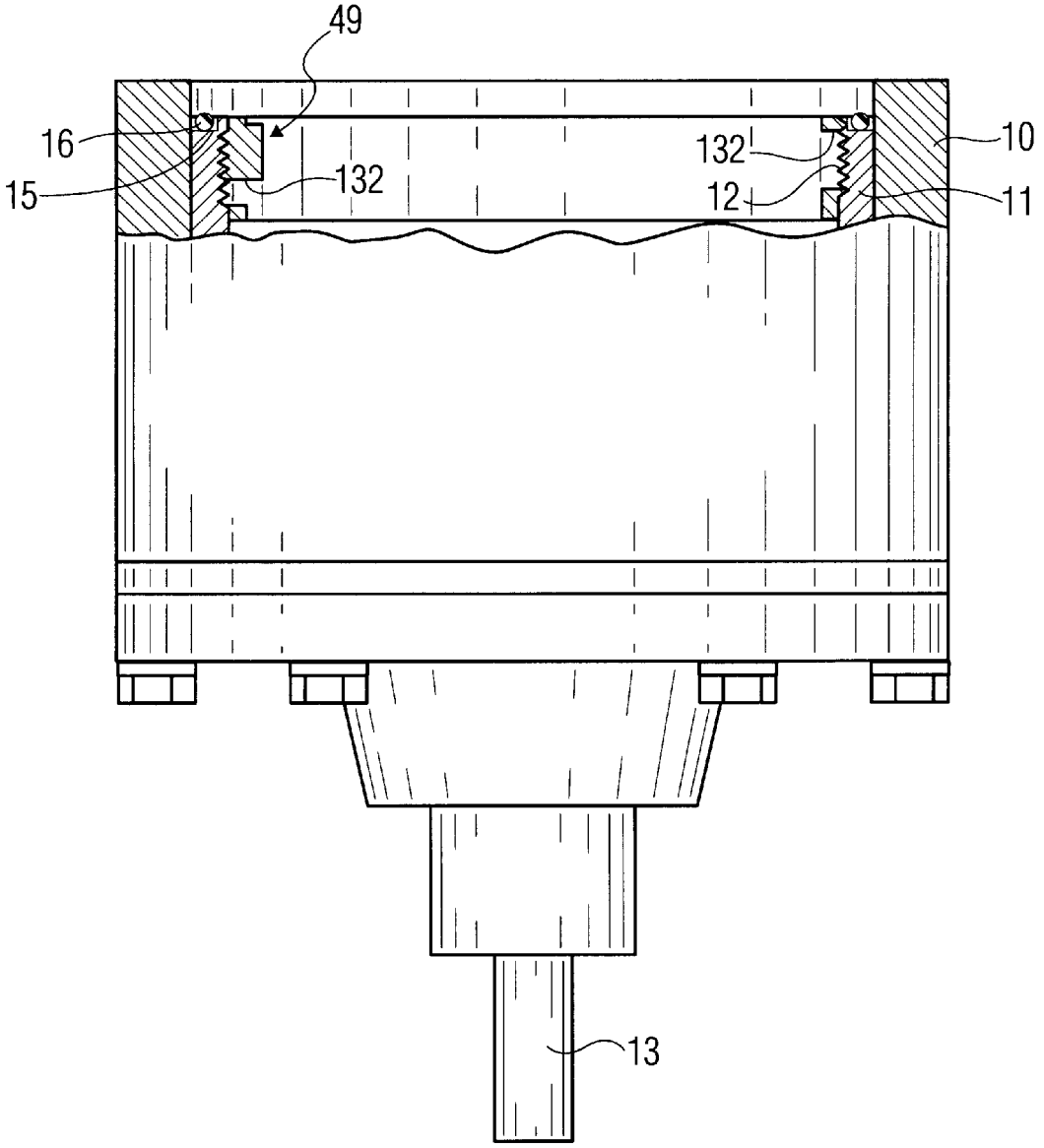
FIG. 14 is an elevational view, partly in section, showing the adapter ring in place within an open conventional deck box housing, the cover having been removed.

In many circumstances, it may not be practically feasible to replace an existing installed deck box, as shown in FIG. 1, with the deck box according to the present invention. In such a case, it is desirable to retrofit the existing deck box so as to accept a cover according to the present invention, as illustrated in FIGS. 4 and 5. For this reason, the present invention contemplates an adaptor cooperable with a conventional deck box as shown in FIG. 1. Such an adaptor is illustrated in FIGS. 12–14.

Figure 12:
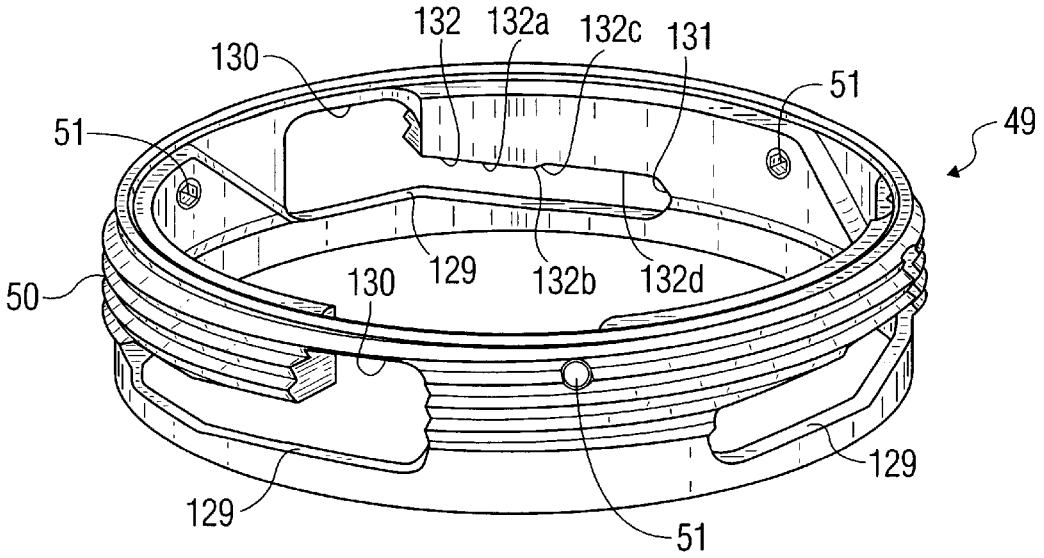
FIG. 12 is a perspective view of an adapter for retrofitting a conventional deck box to provide the advantages of the present invention.

The illustrative adaptor ring 49 shown in FIG. 12 is provided with an external screw thread 50 cooperable with the internal screw thread 12 found in the shell 11 of a conventional deck box. Ring 49 is formed with three grooves 129, which in the present example are actually cut through the entire thickness of ring 49. (In this description, parts of ring 49 comparable to the elements of the deck box illustrated in FIGS. 2–11 bear the same reference numerals as the parts of the previously described embodiment preceded by the number "1".) As before, three grooves 129 are provided, each extending along the circumference of ring 49 for an angular dimension of about 90°. Each groove is also arcuate in shape, in that it follows the circular shape of the ring.

Like each groove 29 described above, each groove 129 includes a tongue-entry end 130 having a radial dimension greater than the radial dimension of the remainder of the groove. Extending from entry end 130, each groove presents a downwardly facing cam surface 132, having a downwardly inclined portion 132*a*, a latch point 132*b*, a short upwardly inclined length 132*c*, and a horizontal section 132*d* adjacent to the locking end 131 of the groove. These portions of cam surface 132 cooperate with the tongues 35 of cover 23 in exactly the same manner as described above in connection with cooperation of tongues 35 with grooves 32. The cover used with a deck box retrofitted with adapter ring 49 can be identical to the cover described above, except that the length of tongues 35 must be shortened to avoid engaging the inner surface of shell 11.

In use, adaptor ring 49 is threaded into shell 11, by rotating engagement of screw threads 50 with threads 12. Once in place, screws (not shown) can be employed extending through the housing into internally threaded holes 51 in ring 49 to hold the ring in place. Once ring 49 is assembled with a conventional deck box, as shown in FIGS. 13 and 14, opening and closing the deck box, and locking and unlocking the cover in place, proceeds as described above with respect to the deck box of FIGS. 2–11.

FIG. 13, which shows the deck box from above, with the cover removed, illustrates a square receptacle 52 adapted to accept the end of body 46 of wrench 14 (FIG. 2) in order to operate the mechanism within the deck box.

It will be appreciated that the present invention eliminates the problems attendant to use of the screw thread connection 12,18 (FIG. 1) between the cover and housing of a conventional deck box. Any grit or wax which finds its way into grooves 29, or on to tongues 35, will have little or no effect on the ability to move the tongues within the grooves, since these elements are so much larger than the dimensions of the typical screw threads. In addition, since the tongues need only be rotated about 90° or so to lock or unlock the cover, the cover can be closed or opened much faster than with a cover screwed into place. Also, since each tongue extension 35*a* snaps into locking position as it slides past latch point 32*b*, the user by sense of feel knows that the cover has reached its fully closed position.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A deck box for a marine vessel having a deck provided with an opening for accommodating the deck box, the deck box comprising:

a cylindrical housing adapted to be mounted within the deck opening, the upper end of the housing being open to provide access to operation mechanism within the housing, a circular cover for closing the open upper end of the housing, and means for securing the cover within the housing, the securing means including:

a locking tongue carried by the cover, the tongue being spaced beneath the lower face of the cover and projecting in a radial direction, and the tongue having a circumferential length less than 360°, and an arcuate groove located within the housing, the groove extending for less than the full circumference of the housing interior, the groove having a tongue-entry end and a tongue-locking end, the locking end of the groove cooperating with the tongue to limit rotation of the tongue to less than 360°, and the groove having a downwardly facing cam surface which is inclined downwardly from the entry end toward the locking end of the groove, whereby when the cover is inserted into the housing with the locking tongue at the entry end of the groove, rotation of the tongue causes it to slide along the cam surface of the groove and draw the cover downwardly into the housing.

2. A deck box as defined in claim 1 wherein the cover-securing means includes a plurality of locking tongues cooperable with an equal number of grooves within the housing.

3. A deck box as defined in claim 1 wherein at a latch point in the cam surface between the entry and locking ends of the groove, the cam surface changes direction and becomes inclined upwardly, thereby defining a locking position for the tongue between the latch point and the locking end of the groove.

4. A deck box as defined in claim 3 wherein the cam surface is horizontal between the latch point and the locking end of the groove.

5. A deck box as defined in claim 3 including a resilient element between the cover and the shell, the resilient element being compressed as the cover moves into the shell in response to rotation of the tongue.

6. A deck box as defined in claim 5 wherein the resilient element is an O-ring.

7. A deck box as defined in claim 3 wherein the resilient element urges the tongue against the cam surface when the tongue is in its locking position.

8. A deck box as defined in claim 1 wherein the tongue-entry end of the groove is at a radial distance form the axis of the shell greater than the smallest radial distance of the cam surface form the axis of the shell.

9. A deck box as defined in claim 1 wherein the cover comprises a outer ring and an inner disk, the disk being rotatably accommodated within the ring, and the tongue being fixed to the disk.

10. A deck box as defined in claim 9 including means for interconnecting the ring and disk to prevent their separation.

11. A deck box as defined in claim 10 including an O-ring seal between the ring and disk.

12. A deck box as defined in claim 9 including means for rotating the disk, and hence the tongue, while the ring remains stationary.

13. A deck box as defined in claim 1 including a screw thread in the interior surface of the housing near its upper end, and an adapter ring having an external screw thread cooperable with the housing screw thread, the interior of the adapter ring being formed with the groove.

14. For use with a marine vessel having a deck box mounted in an opening in the deck of the vessel, the deck box including a cylindrical housing having an open upper end and an internal screw thread near its upper end:

an adapter ring having an external screw thread cooperable with the internal screw thread of the housing, and a cover for closing the open upper end of the housing, the adapter ring having a groove extending for less than the full circumference of the ring, and the cover having a radially-extending tongue beneath its lower face adapted to engage the groove in the ring so as to secure the cover to the housing.

15. A deck box for a marine vessel having a deck provided with an opening for accommodating the deck box, the deck box comprising:

a cylindrical housing adapted to be mounted within the deck opening, the upper end of the housing being open to provide access to operation mechanism within the housing, a circular cover for closing the open upper end of the housing, and means for securing the cover within the housing, the securing means including:

a plurality of locking tongues carried by the cover, the tongues being spaced beneath the lower face of the cover and projecting in a radial direction, and a plurality of arcuate grooves located within the housing, each groove extending for less than the full circumference of the housing interior, each groove having a tongue-entry end and a tongue-locking end, and each groove having a downwardly facing cam surface which is inclined downwardly from the entry end toward the locking end of the groove, whereby when the cover is inserted into the housing with a locking tongue at the entry end of a respective groove, rotation of the tongues causes them to slide along the cam surfaces of their respective grooves and draw the cover downwardly into the housing.

* * * * *